United States Patent [19]

Houser

[11] Patent Number: 4,860,650

[45] Date of Patent: Aug. 29, 1989

[54] METHOD FOR ATTAINING LONGITUDINAL REGISTRY OF ROLLS IN PRINTING PRESSES

[76] Inventor: Lee F. Houser, 855 Maple Tree La., Nazareth, Pa. 18064

[21] Appl. No.: 76,128

[22] Filed: Jul. 21, 1987

[51] Int. Cl.[4] ..... B41F 7/22; B41F 5/16; B41L 29/00

[52] U.S. Cl. ..... 101/211; 101/181

[58] Field of Search ..... 101/211, 178, 181, 171, 101/174, 248, 378, 415.1, 216, 212, 426; 33/618, 617

[56] References Cited

U.S. PATENT DOCUMENTS

| | | | |
|---|---|---|---|
| 1,083,543 | 1/1914 | Kroenert et al. | 101/178 |
| 3,160,094 | 12/1964 | Bean | 101/181 |
| 3,218,969 | 11/1965 | Nagel | 101/181 |
| 3,662,472 | 5/1962 | Johnston | 101/181 |
| 4,033,259 | 7/1977 | Schuhmann | 101/174 |

*Primary Examiner*—J. Reed Fisher
*Attorney, Agent, or Firm*—O'Keefe & Wilkinson

[57] ABSTRACT

A method of and apparatus for rough registration of printing rolls, or plate cylinders, is provided which makes use of a strip gage, preferably formed from a plastic material, and a pointer or indicator to indicate positions on the plate cylinders at each printing station of the press. The printing press is first rough registered in a normal manner for such press and the center lines of the cylinders and of the printing plates on the plate cylinders are aligned. A mark is then made under the pointer in each station on the roll to indicate the rough registration position of the cylinder in the press after registration. The plastic gage strip is then laid about the cylinders either in the press or after the plate cylinders have been removed and the strip and the cylinders are aligned and the station marks originally made under the pointer are transferred from the cylinders to the strip for each station. The largest and the smallest sets of plate cylinders may be used to make an individual gage strip directly and gage strips for sets of plate cylinders of in-between dimensions are then preferably formed by laying out a series of strips between the larger and the smaller cylinder strips and marking the stations on such strips along diagonal lines. Self registering plate cylinders for each set of cylinders are then provided by transferring the station indications for each station onto the cylinder surface of each set of plate cylinders. The plate cylinders can then be remounted in the press at any time for that particular set of cylinders and configuration of press and be immediately placed in rough registration by aligning the cylinder by hand with the pointer indication at that station.

18 Claims, 6 Drawing Sheets

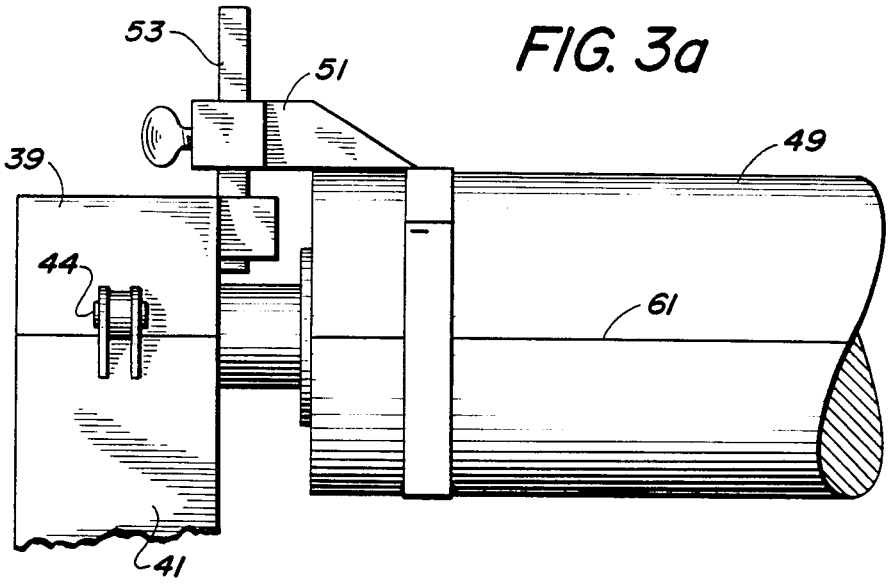
FIG. 3a
FIG. 14
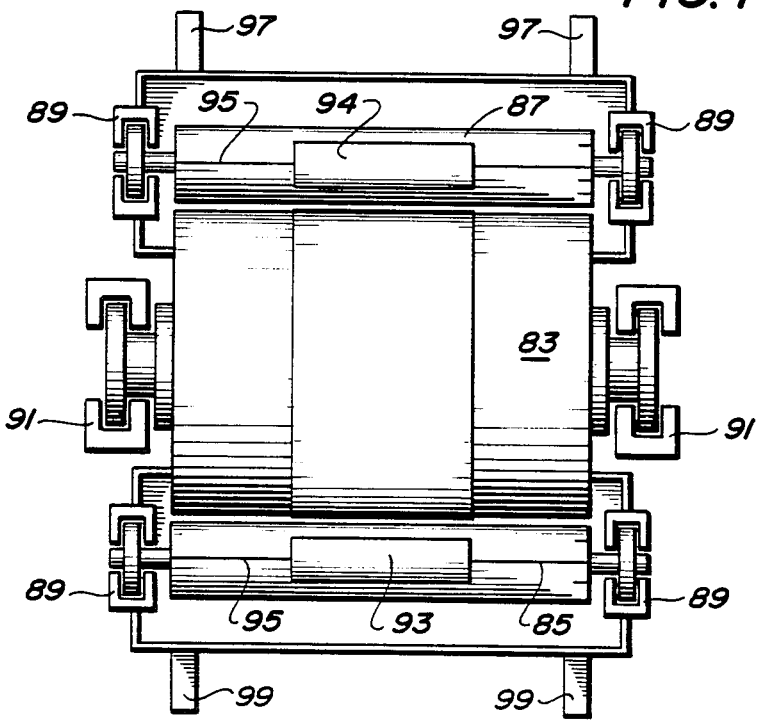

METHOD FOR ATTAINING LONGITUDINAL REGISTRY OF ROLLS IN PRINTING PRESSES

BACKGROUND OF THE INVENTION

1. Field of the Invention

This invention relates to color printing and more particularly to the alignment of the printing rolls, or plate cylinders, in a multicolor printing press for circumferential registry. More particularly still the invention relates to a method and apparatus by which the printing roll of a multicolor printing press such as, for example, so-called flexographic, gravure and lithographic presses can be conveniently and economically prepared for reuse in the press without trial and error type realignment of the rolls for circumferential registry.

2. Description of the Prior Art

Rotating roll type printing presses are currently used for printing multicolor images or impressions as well as single color orders printed at multiple stations on flexible materials such as paper, cloth and plastic materials. Such rotary type printing presses, may, for example, be so-called flexographic, gravure and lithographic presses in which the print repeats vary. In such presses a flexible printing plate is attached to a rotating print roll or plate cylinder. A series of rolls or plate cylinders are used, one for each color which is to appear in the image or in adjacent images usually referred to as "impressions". For example, if there are to be four colors in an impression there must be four active printing stations in the press. Each station is provided with a printing roll, or plate cylinder, upon which is mounted, usually by glue adhesion, a flexible rubber or the like plate which carries the portion of the printed image or impression which is to be one of the four colors. Next to the plate cylinder is mounted an impression cylinder or roll over or around which the material to be printed passes between the two cylinders. An ink transfer cylinder is usually mounted on the opposite side of the plate cylinder. The ink transfer cylinder in turn is usually mounted against an ink cylinder which operates partially submerged in an ink well or reservoir. In operation, the ink cylinder as it rotates draws ink from the ink reservoir on its surface by wetting the surface and transfers such ink by contact to the surface of the ink transfer cylinder which in turn every time the plate cylinder rotates transfers ink of the color drawn from the ink reservoir to the flexible printing plate on the plate cylinder by contact. This ink is then transferred as a part of an image or impression from the printing plate to the material being printed as the plate cylinder is rotated about its axis to bring the printing plate into contact with the material as it passes over the impression cylinder. The impression cylinder serves to support the flexible material upon which the printed impressions are being formed. The material being printed is usually in the form of a strip or sheet of some sort which is pressed against the printing plate on the plate cylinder as the material rotates while supported on the surface of the impression cylinder past the plate cylinder. Each of the four colors of which the complete image is to be comprised is applied to the material being printed from a plate cylinder and printing plate at a different station in the printing press. Since all the colors cannot be applied simultaneously, but must nevertheless be applied to the same general portion of the printed material, it is necessary that the colors be applied consecutively in precise coordination with each other to form a complete image.

One of the major problems in multicolor printing is coordination of the impressions with each other in so-called registry. Since the various colors must be applied serially or consecutively, it is important, and in fact critical, that they be applied in exactly the right place on the printed material. If not, the image will be distorted and if the colors overlap even a fraction of an inch, the image will be unsatisfactory. Thus the registry of the printing plates as they consecutively print portions of the image or impression is of great importance. Registry is a problem with flat bed presses, but is an even greater problem with conventional rotary type presses and a greater still problem with so-called flexographic presses which because of their speed use very fast drying ink.

Transverse or lateral registry or misregistry is not as severe a problem as longitudinal misregistry. Longitudinal registry is frequently referred to as circumferential registry or misregistry, i.e. misregistry measured with respect to the circumference of the plate cylinder. Various guides can be used to hold the plates and plate cylinders in transverse registry, but since the material moves longitudinally, no guides can be used to effect longitudinal registry of the material. Each printing roll, or plate cylinder, has a fixed circumference, furthermore, and any portion of the printed image or impression will thus repeat regularly over a distance along the printed material equal to such circumference. But when two rolls or plate cylinders are placed adjacent to each other in a printing press the distance printed material travels in passing from tangent contact with one to tangent contact with the next is seldom if ever the same as the repeat distance of either roll or plate cylinder. Consequently, if an adjacent plate cylinder is to essentially repeat the image or impression of a prior plate cylinder, as is necessary if the second plate cylinder is to fill in a different color in the same image or impression printed by the first, the surface of the second plate cylinder must be either retarded or advanced so the repeat distances will be coordinated and the impressions aligned. The problem is accentuated if a repeat pattern of the same image is to be repetitively made, as is usually the case in any high volume operation, and as a result the same diameter plate rolls are customarily always used together in a printing press as a matched set. Thus, there will be a stock of a number of sets of plate rolls for a press, each set being of the same diameter or, more importantly, the same circumference.

The printing plates, which are conventionally about one eighth inch thick, are adhesively secured to the surface of the plate cylinders. If, for example, a four color or six color press is being used there could be either four or six or as few as two of the same diameter or circumference plate rolls for each set. The particular diameter set which is used is determined by the necessary repeat distance. However, since it would be impractical to provide an infinite number of sets of plate rolls or cylinders to provide all possible necessary repeat distances, the size of the cylinder is used only to provide roughly the registry required and other means are used to provide the final adjustment.

The first of such other means is a trial and error alignment of the rolls or plate cylinders to effect so-called rough registration when the plate cylinders are first mounted in the printing press. The set of matched cylinders, after having the appropriate printing plates adhered to their surfaces, are mounted in the printing press in approximate or estimated registry. The press is then operated for a short run and the printed materials are examined to see how much misregistry is present. The cylinders are loosened and turned by hand to remove such misregistry and the press is again run for a short period. Four or five trials by an experienced pressman are usually sufficient to roughly register the plate cylinders in the press. Fine or final registry is then usually accomplished by special adjustment of the press usually referred to as machine adjustment.

Final registry adjustment may be effected depending upon the printing press mechanics either prior to engaging the press drive or during operation of the press to effect perfect or final registry. A number of mechanical devices have been designed to effect the fine registry, usually prior to placing the press in operation. Usually such devices involve the use of so-called change gears by which the plate cylinders may be individually rotated prior to engaging the press drive gears. The individual rotated adjustment is then retained when the press drive is engaged. Other dynamic devices are available which enable the rolls to be individually rotated even while the press drive is engaged so adjustment can be made during actual printing. All these devices are referred to as machine registry devices. Since these devices are designed for fine registry in fractions of an inch, however, and usually in the neighborhood of one half inch, they are not suitable for removing gross misregistry of the plate cylinders. Consequently, rough registration of the cylinders is usually effected manually. The rough registry, if done entirely by trial and error, will often take an experienced pressman from one to one and a half hours and since such rough registration must be effected every time the plate cylinders or printing plates are changed for a new job, such rough registration can result in a very significant amount of down or unproductive time. Modern presses are quite expensive and must operate fairly continuously to recover their cost. Thus down time for rough registering the plate cylinders of the press can be a very important consideration.

Since the registration or misregistration of the rolls or cylinders of the press is dependent upon the distance each cylinder must turn in order to secure a substantial repetition of the impression previously left by the printing plate on a prior roll, but in a different color, and this repeat distance is dependent upon the circumference of the cylinder and the distance between cylinders, proper registration of the plate cylinders can be calculated. However, accurate calculation not only is time consuming, but requires very accurate measurements and it has been customary, therefore, to obtain rough registration by trial and error rather than calculation. The difficulty in attaining rough registration of the plate cylinders is increased by the fact not only that different sized sets of plate cylinders are used in printing presses, but the distances between cylinders or printing stations are adjustable in some modern printing machinery.

Devices and procedures for effecting the rough registration of rolls or plate cylinders in a roller type press have been designed of which the following patents are illustrative.

U.S. Pat. No. 3,160,094 issued Dec. 8, 1964 to L. H. Bean discloses a rough registration system in which the plate cylinders are first rough registered by trial and error in accordance with the traditional method. A longitudinal so-called prime line is then established on the plate cylinder. This marks the location at which the printing plate cylinder is mounted each time. A reference line is then established on the end of each plate cylinder or on the end of the arbor of the plate cylinder at a fixed position relative to the prime line on the surface of the cylinder by which the printing plate is aligned. Preferably the reference line will be at right angles to the prime line. The angle of the reference line with respect to a gravitationally established constant horizontal or vertical reference is then measured for each cylinder of the rough registered set-up and the angles are recorded. When the same set of plate cylinders are then again used, the recorded angles may be retrieved from the records and the cylinders aligned so that the originally recorded angles are duplicated without trial and error alignment. It is claimed that the Bean method allows a set of plate cylinders to be rough registered within a few minutes. Whatever the time, which is less than registration by trial and error, it remains necessary to remeasure the angles, usually by a leveling device, which in itself is time consuming, and the Bean method has consequently not come into widespread use.

U.S. Pat. No. 3,662,472 issued May 16, 1962 to J. R. Johnson discloses a template for use in setting the repeat distances of adjacent plate rolls by angular position. The template is provided at one end with a series of ring segments which fit over the mandrels of a series of printing plate rolls in succession. The ring segments are rotated to indicate the angular displacement of the roll necessary to bring the repeat position of such roll indicated by the pitch mark on its surface into coordination with the distance of such roll along the material being printed from the first printing plate roll of the press. A pointer is used to coordinate the pitch mark on the roll surface with the angular indications on the ring segments. The apparatus of the invention of the patent requires the moving of the ring segments or template from roll to roll during set up and the calculation of the mathematic relationship between the angular repeat distance on the roll and the repeat distance along the printed material.

There has been a need therefore for a simple and reliable means and method for effecting a rough registration of the plate rolls or cylinders in a roller printing press without time consuming manipulations, measurement, or trial and error set up runs.

It is an object of the present invention, therefore, to provide a method and apparatus for quickly rough registering printing plate rolls or cylinders once an initial printing set up is effected by trial and error.

It is a further object of the invention to provide printing plate rolls or cylinders marked in a manner which allows them to be set up for reprinting without any substantial calculation or manipulation.

It is a still further object of the invention to provide a measuring means in the form of a permanent strip which can be used to prepare new or old plate rolls for quick rough registration in a roller printing press.

Still another object of the invention is to provide a method for facilitating and effecting rough registration of printing plate rolls or cylinders which may be carried out by relatively unskilled personnel.

Another object of the invention is to provide a method and apparatus for registration of printing plate rolls or cylinders which is applicable to both stack and drum type printing presses and which is equally applicable to both integral and demountable sleeve printing plate rollers or cylinders.

Still another object of the invention is to provide a method and apparatus for effecting rough registration of plate cylinders which requires no costly modifications in the plate cylinders or roller presses as presently used.

Further objects and advantages of the invention will become apparent from the following description and appended claims and drawings.

SUMMARY OF THE INVENTION

The present invention provides an improved method and means for rough registering printing plate rolls or plate cylinders in a roller or rotary type printing press. The method of the invention begins as in previous methods with an initial registration of the rolls or cylinders of the rotary press in the rough mode by trial and error. The rolls are then in a preferred embodiment of the invention subjected to fine or final registry, though this is not necessary in the broad embodiment of the invention. Preferably the largest set of plate rolls for the particular press and the smallest set of rolls are at least rough registered. Each roll or cylinder will have a preapplied longitudinal center line on its surface preferably extending from side to side with which center line the center line of each printing plate is aligned. The press will also have been provided with a pointer which projects at least partially over one side of the roll or cylinder when mounted in the press. The pointer is preferably positioned above the plate cylinder and on the center line of the cylinder journal. Each plate cylinder position or station may be supplied with a permanent pointer arrangement, but will usually be supplied with a means for attachment of a temporary pointer which can be moved from one roll position or station to another as the plate rolls or cylinders are aligned or mounted. After the press has been initially rough registered and, as indicated above, preferably fine or machine registered, a flexible strip of material with a preapplied transverse center line is prepared and in the simplest, although not in an alternative preferred embodiment of the invention, laid directly around one end of the plate roll or cylinder under the pointer with an arbitrary line or other indication, which is usually a center line on the strip, aligned with an arbitrary line on the roll or cylinder which is usually the center line of the roll or cylinder.

A mark, preferably in the form of a transverse line, is made on the strip under the pointer and the mark or line designated by an identification of the plate cylinder station for which the measurement or indication was recorded. Usually the number one plate cylinder position in the press will be recorded first and then the number two cylinder position and so forth until the longitudinal strip has an indication of the pointer position for each plate cylinder in rough registration recorded on it. When that same set of plate cylinders is again mounted in the press the cylinders can be registered merely by aligning the center line of each cylinder with the center line of the strip and then aligning the pointer mark for that cylinder with the pointer. This will rough register each plate cylinder of that cylinder set or series. The present invention, however, preferably proceeds farther and includes the two following further improvements. One of these is the transfer of the pointer position designations on the strip to the surface of each of the plate cylinders of said set of cylinders, usually by permanently inscribing on the surface of the cylinders. The second improvement is a procedure whereby only the largest and smallest diameter set of plate rolls or cylinders for the particular rotary type press are actually rough registered by trial and error and the actual cylinder or roll positions recorded on longitudinal flexible strips.

Assuming that a complete set of plate rolls or cylinders in equal diameter increments is available, a flexible strip may be prepared for each cylinder. The strips are then laid out side by side in decreasing or increasing order of diameter of their respective cylinders with the end lines corresponding to the cut off point on the rolls, which end lines or marks are preferably all made at a uniform location with respect to the end of each strip, aligned with each other and a diagonal line is run from the cylinder or pointer designations of the smallest set of cylinders to the same cylinder or pointer designations (No. 1, No. 2, etc.) for the largest set of cylinders. A corresponding mark is then made on each strip for each set of plate rolls or cylinders. The marks on the individual strips are then transferred to each of the individual cylinders of each set of plate cylinders. Thereafter any cylinder of each individual set can be placed in any position in the rotary press and the cylinders immediately brought to rough registry and locked into position as they are mounted by merely aligning the appropriate cylinder mark on its surface with the pointer over the cylinder. The entire set of plate cylinders is thus quickly and easily brought into rough registry and within machine registry.

In a preferred embodiment of the invention instead of physically laying out the various flexible strips in side by side relationship and then projecting or extrapolating the individual pointer marks directly onto the individual strips, a large layout sheet is instead prepared, the pointer marks on the gage strips for the smallest and the largest set of plate rolls or cylinders are transferred onto the top and bottom or other appropriate location on the layout sheet and the pointer marks for the intermediate sized sets of rolls or cylinders are then extrapolated or projected upon corresponding points on the layout sheet. The pointer marks for intervening size sets of rolls can then be transferred to individual gage strips or even a universal gage strip for all roll sets and the gage strips can thereafter be used directly to rough register the individual rolls or can be used to transfer the pointer marks to the individual rolls.

In a further preferred embodiment of the invention a cut off mark is determined on the #1 plate cylinder which will be 180 degrees around the cylinder from the center line. A line or indication is also established on the end of the strip about one inch from the end, a strip about four inches longer than the repeat distance of the largest rolls or plate cylinders having been selected. At the conclusion of the initial rough registration of the plate cylinders by conventional means thereafter the press is jogged if necessary to bring the cut-off mark under the pointer at the #1 station on the press rather than the center line of the number one cylinder under the pointer. The pointer is then transferred to each station in the press and a mark is made on each cylinder under the pointer. This mark may be referred to as the station mark. After marking of each cylinder, the cylinders are preferably dismounted from the press. The gage strip is then laid about the #1 cylinder with the end mark on the strip positioned over the cut-off mark on the cylinder. A mark is made on the strip over the center line of the cylinder, which, as noted above, corresponds with the center of the printing plate. The strip is then laid in turn about each cylinder of the set of plate cylinders with the center line of the strip positioned over the center line of the cylinder and the station mark previously made on the cylinder is transferred to the gage strip. Once two strips are prepared, one each for the smallest and the largest set of cylinders, the previously explained procedure for using the gage strip for the largest and the smallest sets of cylinders for the printing press is followed to prepare a gage strip for each size set of plate cylinders and thereafter station marks are made on each of the sets of cylinders for the press using the prepared strips so that the cylinders for that set and arrangement of the press can thereafter be set up or used without trial and error registration.

The initial use of an end mark on the gage strip and alignment of such end mark with the cut off point on the first plate cylinder rather than positioning the center point of both the plate cylinder and the gage with each other is convenient because it assures that a gage only a little longer than the repeat distance of the plate cylinder will be sufficient to contain all the station marks for such set of rolls or cylinders and that such station marks will be more or less evenly spaced on both sides of the center line. Otherwise a significantly longer gage strip would be necessary to insure all the marks being encompassed within the space of one gage strip.

As noted above the positions of the rolls in the press are first rough registered either by calculation or more usually by trial and error to bring the press into initial rough registry. The procedure of the invention is then followed to produce the gage strips and the premarked or preregistered rolls or cylinders of the invention for subsequent rough registration of the press each time the same set of plate cylinders is used. It was also noted, however, that in a preferred embodiment of the invention the press rolls will be initially fine or final registered as well as rough registered. This initial fine or final registration has been found to be very advantageous since the subsequent rough registration of the plate cylinders by the procedure of the invention will then be based upon an initial final registration rather than rough registration. The initial rough registration attained in accordance with the invention will in this manner be considerably closer to final registration and a significant amount of time will be saved in the ultimate final registration. This is because the closer the initial registration is to final registration the fewer adjustments are likely to be necessary to attain final registration. For example, if the rough registration is only a small fraction of an inch from satisfactory registration, only a single machine adjustment by trial and error may be necessary to make it satisfactory. If the rough registration is, however, a larger fraction of an inch away from satisfactory, several machine adjustments are more likely to be necessary resulting in both more time expended in attaining final satisfactory registry and also, and in many cases even more importantly, in the use of more material in attaining final registry. This is because each trial conducted for final registration requires actual operation of the press and printing so that significant paper and ink are used and subsequently scrapped. With the present cost of materials and high operation expenses any possible reduction in machine adjustment to attain final registration can become important.

BRIEF DESCRIPTION OF THE DRAWINGS

FIG. 3*a* is an elevation similar to FIG. 3 viewed from the opposite side of the plate cylinder.

FIG. 14 is a top plan view of a drum type rotary print apparatus with the inscribed plate cylinders of the invention mounted in position to print on flexible material.

DESCRIPTION OF THE PREFERRED EMBODIMENTS

Figure 1:
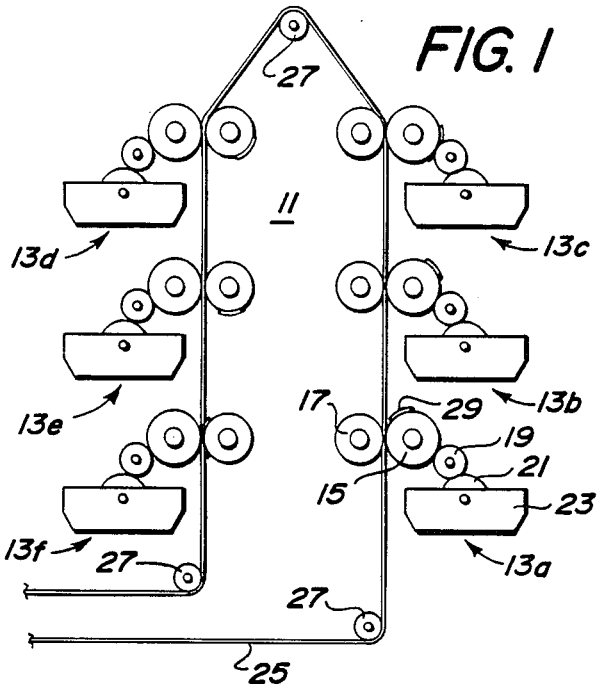
FIG. 1 is a schematic sketch of a typical stack type rotary type printing press for which the present invention is useful and which illustrates the basic operation of the press.

The present invention provides a method and apparatus for rough registration, or preregistration of the plate rolls or cylinders in a rotary type printing press prior to machine registration of such cylinders. The invention is intended to reduce the press time and scrap by predetermining at what point the so-called "mesh change gears" or machine registration mechanism will be activated in order that all plate roll or plate cylinder stations within the press will register within the machine adjustments for either advance or retard movement of the individual cylinders during machine registration, often referred to as final registration of the rolls or cylinders. The invention can also be used to reinstall plate cylinders when such cylinders are taken out of the press for plate repair, changing slugs outside the press and the like so that the impression or printing plates will rough register when replaced back in the press.

The invention significantly reduces press set up time and reduces scrap by accurately indicating in what position to place the plate cylinders in the press in order that all colors will be within machine register adjustments. The invention therefore eliminates the need for manually measuring and moving the plate cylinders to register impressions during the initial set up so that the press can then be run and adjusted by trial and error until all colors are preregistered or rough registered. The invention can be applied not only to the registration of different colors, but to multi color operations with over lacquer application, as well as single color orders run in multiple stations. The invention insures the proper placement of all colors and over lacquer prior to actual starting of the press. The invention is applicable to all flexographic and gravure presses, stack type cylinder presses, central impression cylinder presses, and in-line type presses where print repeats are varied. No major machine modifications of the printing press is required, the only modification to the press being the addition of guide blocks permanently bolted to each plate cylinder bearing cap or cylinder lift pedestal portion of the press structure. The only other modification of the press structure or plate cylinder structure is the preferred engraving or other permanent marking of the plate rolls or cylinders with the designation of the registry of such cylinders in each press station for any given set of cylinders. The invention also makes use of a gage strip preferably formed from a thin plastic material, which gage strip may be developed by the printing foreman, the press lead man, a set-up man or the press operator. After the press alignment data is developed and recorded, relatively unskilled labor can effect the actual rough registration of the rolls or cylinders in the press prior to engagement of the change gear mechanism. When using the invention no time is wasted starting and stopping the press, manually rotating plate cylinders and making unpredictable adjustments. In addition no paper is wasted during rough registration by the running out of register impressions. A minimum of paper is also used in effecting the final machine registration.

In accordance with the invention, the first step is to pre or rough register the plate rolls or cylinders of the printing press in accordance with the usual trial and error or other method which is normally used by the press crew for the particular press for rough registering the plate rolls prior to machine registration. After the initial trial and error rough registration is effected, the procedure of the invention is resorted to to provide both a rough registration indicator gage and so-called preregistered plate rolls or cylinders for the printing press. In a preferred embodiment of the invention, the cylinders of the press will not only be initially rough registered, but will in addition be fine or final registered prior to resorting to the procedure of the present invention. This allows each rough registration of the press in accordance with the invention to be based upon a final registration rather than a rough registration and as a result to approach a final machine registration rather than a rough registration by trial and error in accuracy. The additional accuracy results in both a saving in time and in material in accomplishing final machine registration.

The invention will be more particularly described as follows with reference to the appended drawings in which FIG. 1 is a schematic elevation of a stack type roller or rotary printing press 11. The press 11, as shown, has six plate roll stations designated generally as stations 13, each station being more specifically designated as stations 13*a* through 13*f*, each of which is equipped with a plate roll or cylinder 15, an individual impression roll or cylinder 17, an ink transfer roll or cylinder 19, an ink roll or cylinder 21 and an ink well or reservoir 23 in which the ink roll rotates. The plate roller or cylinder will in the description which follows be generally referred to as a plate cylinder, as is customary in the trade.

Each plate cylinder, as is well known to those skilled in the art, is designed to carry a flexible printing plate which is adhered, usually by a glue type formulation, to the surface of the plate cylinder. As a strip or sheet 25 passes over the guide rolls 27 and between the impression cylinders 17 and plate cylinders 15 the printing plate 29 is rotated about the plate cylinder into contact with the strip 25 as it passes between the impression cylinder and the plate cylinder. As the ink roll or cylinder 21 rotates in the ink reservoir 23, ink is removed on the surface of the cylinder from the reservoir and transferred to the ink transfer cylinder 19 which in turn transfers the ink to the surface of the printing plate 29 as it passes between the plate cylinder 15 and the transfer cylinder 19. As will be evident to those skilled in the art, the six impression rolls or cylinders 17 could be combined into or replaced by three dual purpose rolls or cylinders each serving to support the strip 25 at two opposite points on the impression cylinder surface as it passes on opposite sides of the the impression cylinder in contact with two opposite plate cylinders. Many stack type printing presses embody such an arrangement. It will also be recognized by those skilled in the art that the position of the roll or print stations on the printing press structure can be advanced or retarded to some extent to adjust the stations to the required repeat pattern of the particular printing order. It will also be recognized by those skilled in the art that each press such as the press 11 is usually supplied with a series of sets of different sized rolls, which different size sets of rolls are provided to adapt the press operation to variations between different orders.

Figure 2:
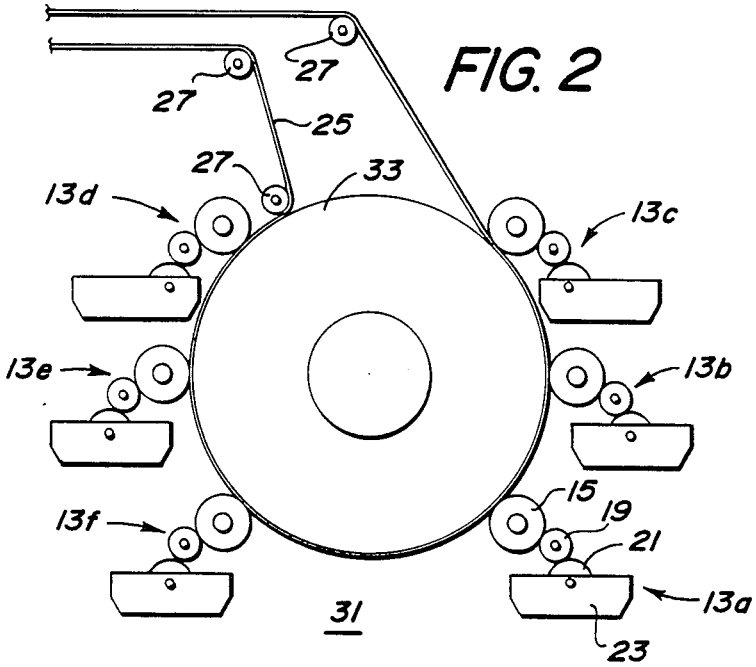
FIG. 2 is a schematic sketch of a typical drum type rotary type printing press for which the present invention is useful and which illustrates the basic operation of the press.

In FIG. 2, there is shown a so-called drum type rotary printing press 31. In the drum type printing press as shown in FIG. 2, a single large central impression cylinder or drum 33 has a series of six plate cylinders 15 positioned at various locations about it as indicated by stations 13*a* through 13*f*. The various parts of only one printing station in each of FIGS. 1 and 2 are individually designated with reference numerals for simplicity, since each station in both Figures has the same individual roll or cylinder arrangement with the exception of the central impression cylinder 33 shown in FIG. 2.

It will be understood by those skilled in the art that every time the plate cylinder 15 rotates the printing plate 29 will be impressed against the strip 25 leaving an inked impression on the strip. The impression or image left on the strip therefor "repeats" with every rotation of the plate cylinder 15. The length between such repeats depends on the circumference of the plate cylinder 15. In order that the second impression from the next plate cylinder, for example, cylinder 15*b* will register either directly over the first impression, as is necessary where a two color picture is to be formed, or adjacent to the first impression, where two different color impressions are to be formed adjacent to each other, the distance along the strip between the tangent point with the plate cylinders at the two stations must be the same as the segment or arc of the circumference of the next printing plate cylinder which will be rotated against the strip 25 before the printing plate 29 on such second plate cylinder comes into contact with the strip 25. Since the distance on the strip and the circumference on the plate cylinder are seldom the same, it is almost invariably necessary to either advance or retard the position of the second plate cylinder with the surface of the strip in order to form a registered image on the final printed material. Such advancement or retardation of the second plate cylinder and every succeeding plate cylinder in order to obtain the proper registry may be accomplished both by calculation of the two distances, i.e. the distance along the strip and the corresponding arc of a circumference of the roll may be calculated, followed by subsequent adjustment of the roll position so that the two may correspond as desired, or the registration may be effected by trial and error. Such calculations, as is well known to those skilled in the art, are tedious and because of difficulties in accurate measurement are frequently not satisfactory.

The principal alternative method of adjusting the two distances is known as the trial and error method in which the two distances are first adjusted by eye to get the position of the roll so that the distance will be close to registry. The press is then operated for a short distance until the plate rolls in question have made their impressions on a portion of the strip. The impressions are examined and if not in registry, as is invariably the case, the set screw or other locking device on the rolls is loosened and the rolls are rotated by hand by a skilled pressman until it is thought they are in registry, at which point the roll locking device is again tightened, the press is again operated for a short distance and the registry is again observed. Such trial and error is continued until the registry is satisfactory to the operators, at which point the rolls are permanently tightened and the rough registration is at an end. At this point the final or machine registration can be effected by operation of mechanical means in the press mechanism which can effect very fine movements of the rolls to attain a superior registration of the images. It usually requires about four short trial and error runs before the proper rough or preregistration is effected in the roll positions.

In accordance with the present invention, the prior rough registration described above is still effected on the first operation of each set of rolls for the press with a particular press set-up. Prior to initiation of the rough registration procedure of the invention the press apparatus will have had added thereto a pointer device 35 shown more particularly in FIG. 3. The pointer device 35 comprises as shown a gage block 37 secured to each plate cylinder bearing cap 39 which is conventionally secured to a plate cylinder bearing mount 41 by a quick acting pivoted bearing cap bolt and pivoted arrangement 43 and 44 respectively. The light but rigid metal pointer gage block 37 is secured to the plate cylinder bearing cap by machine bolts 45 threaded into the bearing cap 39. The center of the gage block is preferably maintained in line with the center of the journal 47 of plate roll 49 as may be more clearly seen in plan view in FIG. 4. FIG. 4 shows the light metal gage block 37 mounted by the machine bolts 45 onto the plate cylinder bearing cap 39 directly above the center of the journal 47 of the plate roll 49. As shown in the Figures a slide shaft 53 is shown inserted into a slide opening 54 (see FIG. 4) in the gage block 37. The pointer 51 is secured to the pointer slide shaft 53 by means of a set screw 55. Normally a gage block 37 will be permanently mounted on the plate cylinder bearing cap 39 of each plate cylinder in the press. The actual pointer mechanism 51 plus the slide shaft 53 will usually, however, be transferred from gage block to gage block in the press as necessary to determine the position of each plate cylinder. Either the pointer itself 51 or the pointer and the pointer slide shaft 53 may be transferred between the gage blocks.

Figure 3:
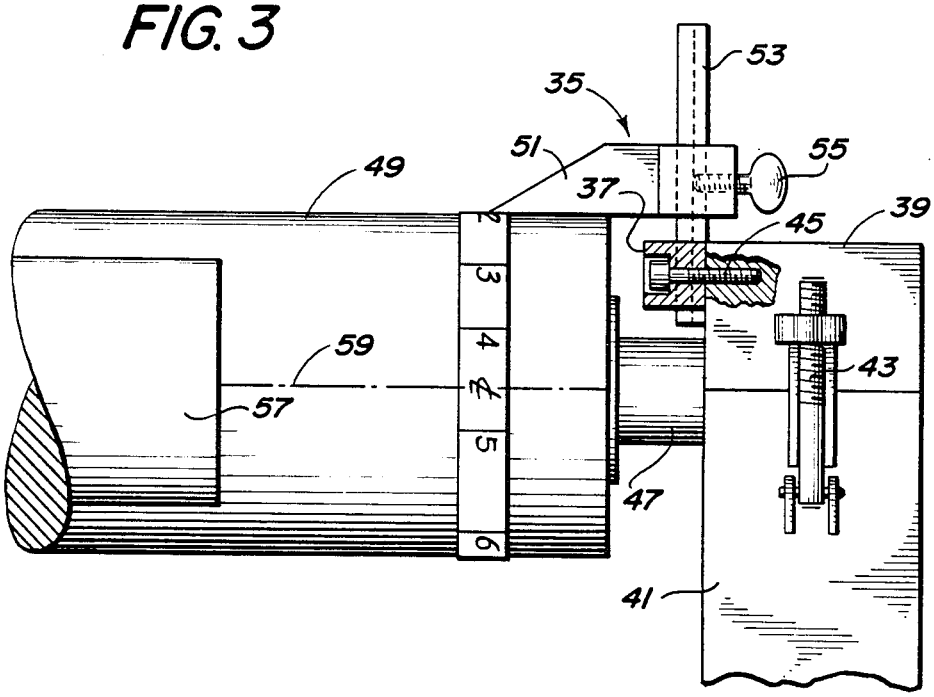
FIG. 3 is an elevation of a portion of one end of a plate cylinder together with some of the associated mounting structure showing a flexible recordation strip wrapped about the end of the cylinder adjacent to an indicating pointer mounted upon the mill structure.
Figure 4:
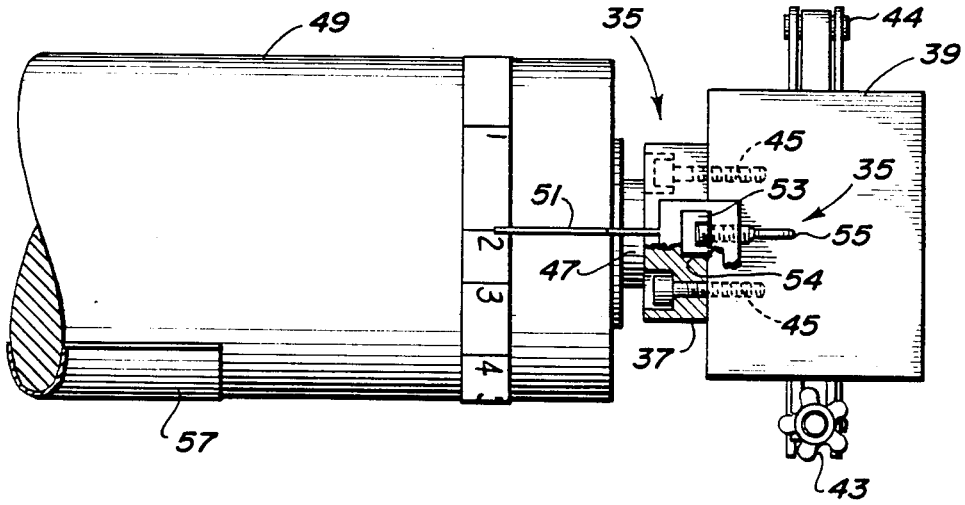
FIG. 4 is a plan view of the same portion of one end of a plate cylinder as shown in FIG. 3.

Also shown in FIGS. 3 and 4 is a projected center line from the printing plate 57 which is adhered to the plate cylinder 49. The center line of the plate and the cylinder are made to correspond. The cut-off line which is 180 degrees about the plate cylinder 49 from the center line is shown diagrammatically in FIG. 3*a* which shows the opposite side of the roll 49 from that shown in FIG. 3. The center line indication on the cylinder is designated as 59 and the cut-off mark indication is designated as 61 in FIGS. 3 and 3*a* respectively. The center line and cut-off line projections may be extended on to the edge of the surface of the cylinder. The pointer 51 serves as a reference for all gage marks made according to the method of the invention. It will be understood that while it is preferred to mount the pointer device 35 as shown on the center line of the plate roll or cylinder 49, for example, on the bearing cap or on the cylinder pedestal, the gage block could be otherwise mounted so long as it indicates a predetermined and unvarying position with respect to the plate cylinders 49. Any other suitable pointer mounting means or structure also can be used.

The cut-off mark for the plate cylinder is only important in the preferred method of the invention for the number one plate cylinder or the cylinder in the number one station of the press. After the gage blocks are mounted and the cut-off mark on the number one plate cylinder and the center lines on each of the cylinders are determined, the plate cylinders are placed in the press and rough registered with each other using the press crew's usual procedure for such rough registration, usually a trial and error procedure. After the trial and error rough registration is effected, and as explained above preferably also a final or fine registration as well, the pointer 51 is mounted on the press by means of the gage block at the number one printing station, i.e. the pointer 51 is mounted over the plate cylinder 49 at the number one station. The printing press mechanism is then jogged to bring the cut-off point on the number one cylinder directly under the pointer 51. The pointer 51 is then removed from the number one station gage block and is mounted in the gage blocks at each of the other successive printing stations and each plate cylinder is preferably marked directly under the pointer. At this juncture each printing plate cylinder has been marked with a line under the pointer position while the plate cylinders are all in at least rough registration and preferably in fine or final registration with each other. Each marked pointer position on each roll is also marked preferably with its own station indication. If the plate cylinders are now dismounted from the printing press for any reason they can be reinserted into the press in a rough or semifinal registered position. However, any one of the set of cylinders of the usual matched set of uniform diameter plate cylinders will frequently be mounted in any station. Consequently, in order to facilitate such mounting the method of the invention proceeds further as described below.

A flexible strip of material which is preferably an acetate material is cut to be preferably about four inches longer than the print repeat, i.e. the circumference of the set of rolls which is being rough registered, and a line is drawn preferably about one inch from one end of the strip completely across the strip. This can be referred to as the end mark. A second longitudinal line or stripe is also marked along one side of the strip to permanently indicate which side of the strip is which. The marked side of the strip is normally positioned to the outside of the roll on the operator's side in the position of the pointer. The approximate center of the strip is also preferably marked with a center line. More preferably still, the repeat interval of the plate cylinder set in question, which is the same as the circumference of the plate cylinders since the printing image is repeated with every revolution of the cylinder, is measured from the end mark and the center line is marked in the approximate center of the repeat interval.

At this juncture all the plate cylinders are preferably removed from the printing press. And if it has not been done before a line is projected from the center line of the printing plate adhered to the cylinder to the edge of each cylinder. The strip is then placed about the number one plate cylinder with the end mark on the strip, i.e. the designation marked on the strip about one inch from the end, aligned with the cut-off mark on the number one cylinder. The strip is not necessarily marked with the pointer position since the pointer is preferably aligned with the cut off line. However, if the strip overlaps, which it customarily will, the overlapped portion of the other end may be marked with the pointer position.

The strip is next wrapped about the number two roll with the center line of the strip aligned exactly with the center line of the printing plate which has been projected, as explained above, on to the edge of the cylinder. After the center line of the strip and the center line of the printing plate and plate cylinder are exactly aligned, the number two station mark on the number two cylinder, which has already been recorded on the cylinder, is marked on the strip as a transverse line across the strip. After this is done the strip is moved to the number three station cylinder, the center line of the strip is again aligned with the center line of the printing plate as projected on the roll and the number three station mark is transferred from the cylinder and marked on the acetate tape. This procedure is continued until a station mark for each station has been transferred from the respective position of such station mark on the respective cylinder for such station to the acetate tape while the center line on the acetate tape is maintained in alignment with the center line of the plate cylinder and plate as previously explained.

Figure 5:
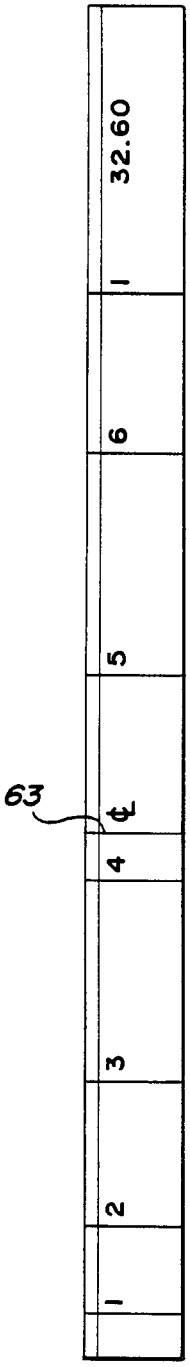
FIG. 5 is a view of the flexible recordation strip laid out after recordation thereof of the pointer positions for each of the roll or cylinder positions of the rotary printing press.

After the acetate tape has been completely marked, a piece of strip, usually also of acetate, will preferably be placed over the marks on the tape to prevent such marks from being rubbed off or otherwise smudged. The acetate strip now constitutes an accurate gage strip for either directly rough registering the rolls of the press or in the preferred method for use in transferring the various station marks to each of the rolls or plate cylinders so that such cylinders may each be universally used in each of the stations of the press. In the latter instance the gage tape designated as 63 and shown in FIG. 5 is placed around each roll and the same station marks, each indicated as station one, two, three, four, five or six, or, as will be understood by those skilled in the art, however many stations there are in the particular printing press or used in the particular printing press set up, are transferred directly to the end of the plate cylinder. Preferably the marks are engraved or otherwise permanently marked on the surface of the plate cylinder at the edge. Any one of the plate cylinders or the set of equal diameter rolls may now be placed in the press at any station. The cylinder may then be aligned for rough registration at such station by hand rotating the plate cylinder in such station with the roll set screw loosened until the station mark is exactly aligned underneath the pointer 51 at such station.

FIG. 5 shows a typical flexible acetate gage strip after completion ready to be used either (a) to mark the appropriate station gage marks on the individual rolls or (b) to be used directly to rough register the plate cylinders in the printing press or (c) to be used with one or more other gage strips to form intermediate gage strips by interpellation as more particularly described below.

Figure 6:
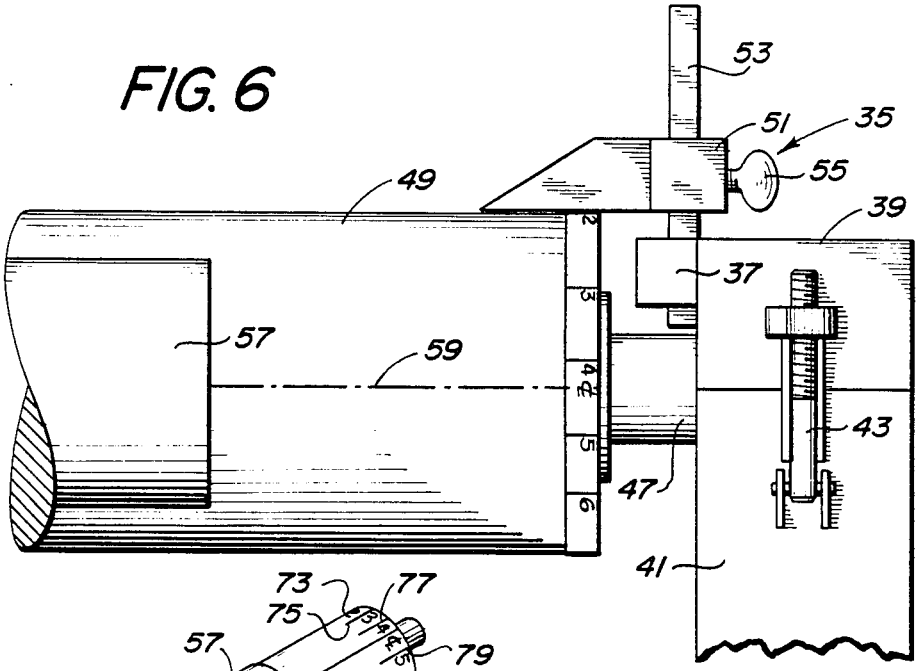
FIG. 6 is an elevation of the same portion of one end of the plate cylinder and associated mounting structures as shown in FIG. 3 with the pointer positions for each roll or cylinder of the set of plate cylinders transferred from the flexible strip shown in FIGS. 3, 4 and 5 onto the surface of the cylinder.

FIG. 6 shows a typical plate cylinder marked in accordance with the invention to form a preregistered plate cylinder mounted in rough registration in one station of the printing press, in this case in station No. 2. The station marks for the cylinder position in the various press stations as well as the center line of the cylinder and printing plate are marked on the surface to prepare the cylinder for preregistration in any of the indicated printing press stations.

The same procedure as explained above could be followed with respect to each set of matched diameter printing cylinders for the printing press. In this manner each set will be provided with surface markings indicating the rough registration position which such rolls should assume when placed in any of the stations of the press. Each roll is consequently converted into a so-called self registering plate cylinder. However, it has been found that it is unnecessary to rough register each set of rolls by the trial and error method and then mark such rolls in accordance with the procedure above. In a preferred embodiment of the invention, therefore, only the largest and smallest set of plate cylinders for the particular printing press are rough registered by the trial and error method and then marked in accordance with the procedure above. With respect to the other remaining sets of rolls for the cylinders of the press the procedure is as follows.

Figure 9:
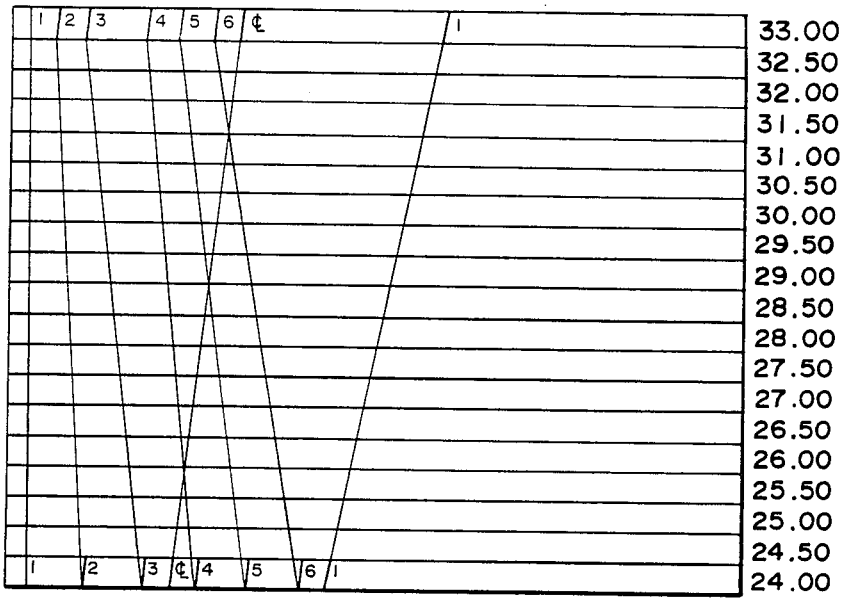
FIG. 9 is a plan view of separate strips for the set of plate cylinders for the press laid out side by side with the top strip having the pointer positions from the largest set of cylinders recorded thereupon and the bottom strip having the pointer positions from the smallest set of cylinders recorded thereupon with diagonal lines connecting corresponding cylinder positions ready for marking the cylinder positions of each set of cylinders on each respective strip.

After a gage strip has been prepared for the largest and smallest set of plate cylinders, a series of blank gage tapes are provided each preferably with a center line and each with an end line or mark as originally provided on the primary gage tapes. A set of gage tapes or strips are arranged in ascending or descending order on a flat surface with an already prepared gage strip for the smallest and largest sets of printing rolls arranged at the top and bottom of such descending series. The end marks on each tape are aligned with each other as shown more particularly in FIG. 9 and then a diagonal line is drawn or established between the corresponding station marks on the gage tapes for the smallest and largest sets of rolls. Each blank gage strip may then be marked under the appropriate diagonal line with a station mark for the particular press station which each diagonal line indicates. After this is accomplished for each station position on the tapes and the acetate tapes are provided with an adhesive tape overlay to protect the marks, a permanent record of the rough registration positions of each set of rolls for the particular printing press and for the particular arrangement of such press will have been formed. Each of these tapes may be stored for future use either in rough registering the rolls of each set of rolls in the press or for marking new machine rolls used as substitute rolls for such set. In the preferred embodiment of the invention, however, each gage strip will be laid about each of the rolls of each set of rolls for which such gage strip has been formed and corresponding station marks will be directly transferred on to the surface of each of the rolls of said set to convert such rolls into self registering rolls in accordance with the invention. It will be seen that the center lines of the strip also form a diagonal line as seen in FIG. 9. This is because the center lines are positioned in the center of the repeat interval which decreases as the circumference of the rolls decrease. The end marks and the center lines necessarily approach each other as the roll diameter decreases.

Figure 10:
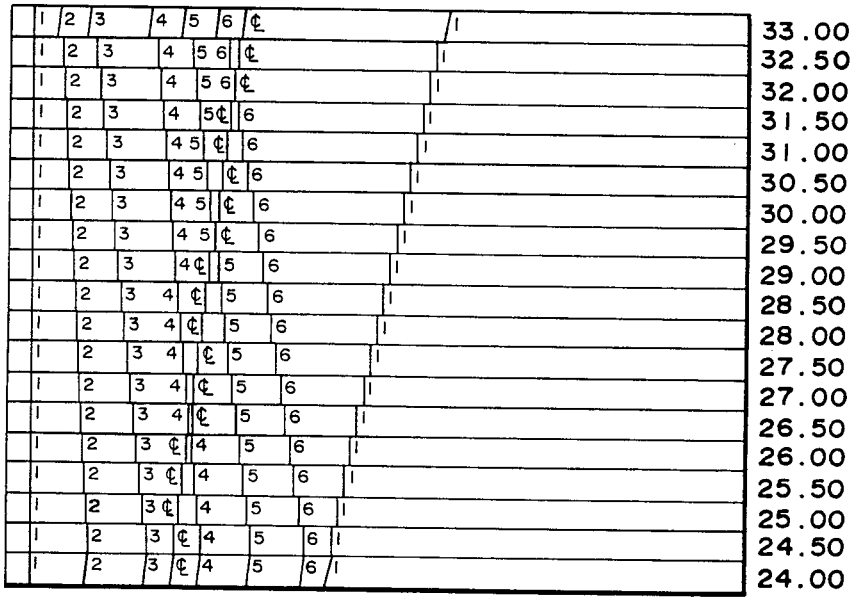
FIG. 10 is a plan view similar to the view of the laid out strips in FIG. 9, but with the actual pointer position for each cylinder of each set of cylinders recorded on the surface of the various strips.

FIG. 9 as indicated above illustrates the laying out of diagonal lines across a series of aligned gage tapes or strips. FIG. 10, on the other hand, shows each of the strips marked with a corresponding rough registration station indication following the diagonal lines, which lines in FIG. 10 have been removed. It has been found that this so-called layout method of practicing the invention provides very accurate gage strips.

In a preferred embodiment of the invention, instead of physically laying out the various flexible strips in side by side relationship a large layout sheet is prepared with appropriate horizontal lines or other indicia to represent both the surface of each plate cylinder or roll and the flexible gage strip, which strip is, as one step in the rough registration system of the invention, wrapped about the surface of the plate cylinders. The horizontal strip representation lines or other appropriate indicia are arranged at equal intervals from each other from top to bottom on the layout sheet. The actual distance of the lines from each other is not critical, but it is important that the lines or other representations be equally spaced and include a line or other indicia or representation of, or at the least take into consideration, each cylinder size from the largest to the smallest sets of cylinders, whether or not each such set actually exists, based upon the smallest existing or contemplated cylinder size interval between two sets of plate rolls or cylinders contemplated for the roller press. In other words, if the smallest size difference between sets of cylinders is one-fourth inch, a line or representation or at least an appropriate space should be provided on the layout sheet for a plate cylinder set or flexible gage strip corresponding to a cylinder set for each quarter inch interval between the largest diameter and the smallest diameter set of cylinders for which actual measurements have been obtained. The length of the lines on the layout sheet is preferably the same as the flexible gage strip, which in turn is preferably somewhat more than the circumference of the largest diameter rolls. A cut-off line and, if desired, a centerline indication is preferably established upon each lineal representation of the roll sets or flexible gage strips on the layout sheet or preferably at least on the lineal representtions of the largest and smallest diameter set of rolls. The cut-off lines are preferably aligned at the left of the layout sheet.

After the basic form of the layout sheet is established, the station points or marks recorded on the flexible gage strips for the largest and smallest set of plate cylinders for the particular roller press are transferred to the appropriate locations on the layout sheet, i.e. the lines representing the station marks on the largest and smallest roll sets are transferred to or indicated along the line or other representation of the largest and smallest set of plate cylinders on the layout sheet. Diagonal lines or projections of lines are then made on or across the layout sheet between corresponding station marks for the largest and smallest set of rolls and a mark or indication is made on the layout sheet at the intersection of each projection and the corresponding line or other representation of each cylinder set or cylinder set interval on the layout sheet. This will, in effect, provide an indication of the station marks for each cylinder set from which a flexible gage strip can then be made. A flexible gage strip is then made for each actual set of plate cylinders for which a gage strip is desired by transferring the marks on the layout sheet to a flexible gage strip. The gage strip can thereafter be used to either align the actual plate cylinders in the roller press or to transfer the required marks to the cylinders themselves so they can thereafter be aligned in rough registration as desired.

Figure 11:
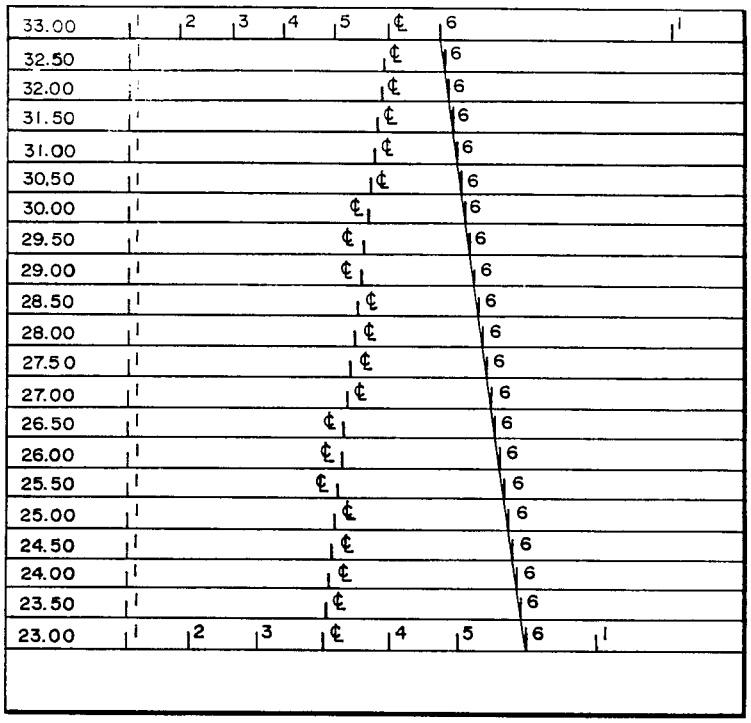
FIG. 11 is a plan view of a layout sheet designed for forming individual flexible gage strips from the station or pointer data provided by two specially separated gage strips showing the initial layout of the sheet.

FIG. 11 shows a typical layout sheet prepared with designations for each individual cylinder set on the sheet, with the station marks for the largest and smallest sets of plate rolls or cylinders already entered upon the layout and with one diagonal line laid out across the sheet between one pair of the same station marks (#6 station) for the largest and smallest sets of rolls. The same station marks have been entered upon the layout sheet at the intersections of the diagonal line and each lineal designation for the various sets of rolls. The center line indication could be directly entered upon the individual gage strips since it is the center of the repeat distance which is the same as the circumference of the roll. However, it is convenient also to indicate the center line on the layout sheet as shown.

Figure 12:
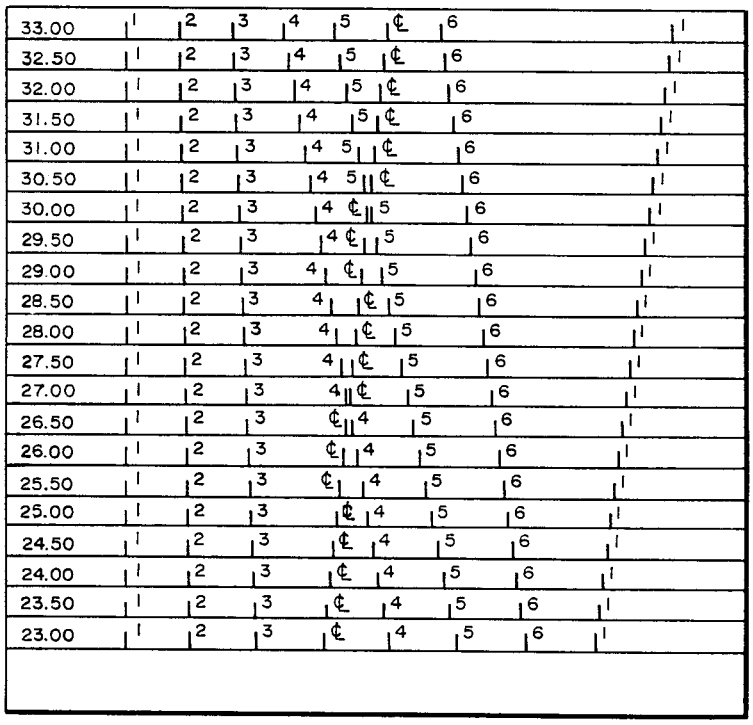
FIG. 12 is a plan view of the layout sheet of FIG. 11 showing diagonal lines projected upon the surface of the sheet along which projections station marks may be found at the intersections of said diagonal lines and horizontal lines representing each set of the series of different sized plate cylinders.

FIG. 12, on the other hand, shows the same layout sheet after completion with the station marks for each cylinder set entered on the layout sheet and the projected diagonal lines, which may be merely projected or physically laid out with a straight edge or the like, removed. It will be understood that the various diagonal projections for each set of cylinders could equally conveniently be maintained upon the layout sheet as actual physical lines even without an indication of the station designation. The intersection of the diagonal line and the horizontal lines would then represent the various stations. It will be recognized that individual or even combined flexible gage strips can be easily prepared by transferring the station mark data from the completed layout sheet as shown in FIG. 12 to the flexible gage strip by laying the gage strip along the corresponding cylinder.set indication on the layout sheet and transferring the requisite data. During transfer of the station marks the cut-off lines of the flexible gage strip and the layout sheet will be aligned.

Figure 13:
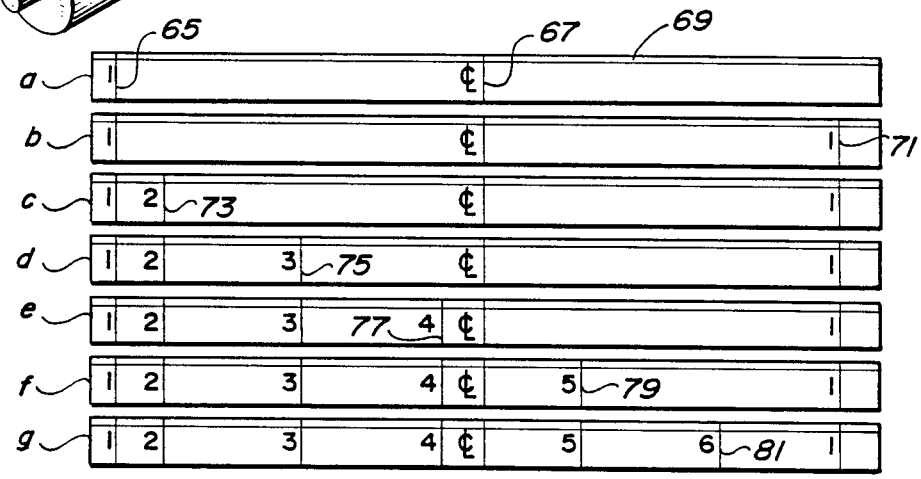
FIG. 13 shows a series of views of a gage strip for one set of plate cylinders as the indication of each station position is added to the gage strip each stage being indicated as a, b, c, etc.

FIG. 13 shows a series of strips (a) through (g) illustrating the progression of making a single gage strip on a six stration press directly from the station marks on the cylinder or else directly from the pointer position when the plate cylinders are rough registered by trial and error. Strip (a) is a strip as it is prepared before making or applying any marks from the specific roll set. Thus strip (a) has a line or stripe 65 to the left about one inch from the left margin of the strip. This is the so-called end mark. A center line 67 in the center of the strip and a longitudinal stripe 69 along the top of the strip are also shown. As explained above, the center line will have been established within the center of the repeat interval of the roll. The stripe 69 indicates the side of the gage strip which will be placed adjacent to the operator's side of the plate cylinders during marking and subsequent use.

Strip (b) has the end mark 65, center line 67 and top stripe 69 and in addition it has been laid about the roll in station number one with the mark 65 adjacent to the cut-off mark 61 as shown in FIG. 3. Station mark number one is already marked on the roll, or, as will presently be seen, is applied directly to the gage strip as it is wrapped in position on the roll surface. Station mark number one is designated in FIG. 13 as line 71. This is actually a duplication of mark 65 since it occurs on an overlap of the gage strip and both marks represent the cut-off point or line on the plate cylinder.

Gage strip (c) in FIG. 13 shows the partially marked strip with the additional station mark number two applied to this strip. Station mark two, which is designated by numerical designation 73, will have been applied to the strip either, as explained above, by laying the strip about the number two station roll with the center line of the strip positioned on or aligned with the center line of the roll and then transferring the station mark number two indication or gage mark which has already been marked on the roll from the roll to the strip or by directly marking the strip while it is wrapped about the roll with an indication of the pointer location. Strip (d) in FIG. 13 shows the strip with the additional station mark for station number three applied to the strip in the proper position in the same manner as explained for strip (c). The station mark number three is indicated on strip (d) by the numeral representation 75. Strip (e) in FIG. 13 shows the strip with the further station designation number four indicated by the numerical designation 77 on the strip. Likewise strip (f) of FIG. 13 shows a strip with a numerical designation 79 indicating the fifth plate cylinder station position. Lastly strip (g) indicates the strip with the last station designation six indicated by the numerical designation 81. It will be evident to those skilled in the art that the further station designations applied to the strip as shown in (e), (f) and (g) are applied in the same manner as the previous designations two and three shown on strip (c) and (d). It will also be recognized that if there were fewer stations on the press, there would be fewer designations on the strip and if there were more stations on the press there would be more station designations marked on the strip shown in FIG. 13.

Figure 7:
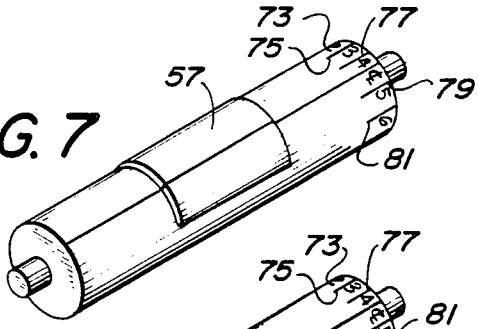
FIG. 7 is an isometric view of another cylinder from the same set of plate cylinders for the same rotary type press, the cylinder being dismounted from the press with the marks from the flexible strip transferred to the surface and ready for the cylinder to be mounted in the rotary press for immediate rough registration.

FIG. 7 shows a roll plate cylinder in accordance with the invention with typical roll press station designations previously marked on its surface. In FIG. 7 can be seen the number two station designation marked with reference numeral 73, the number three station designation marked with reference numeral 75, the number four station designation with reference numeral 77 the number five station designation marked with reference numeral 79 and the number six station marked with reference numeral 81. The plate cylinder center line 59 is also visible, as is a printing plate 57 secured to the surface of the roll in alignment with the center line 59. As will be understood from the above description, the roll 49 shown in FIG. 7 is self registering to the extent that it can be taken out of the printing press and reinserted into any of the stations of the printing press with a minimum of labor and difficulty as well as by relatively unskilled labor who need only determine that the station designation for the particular station in which the cylinder is mounted is aligned with the gage pointer which is provided at each station. When alignment is attained the roll will be rough registered. All that then need be done to start the printing press after the other plate cylinders of the other print stations are also rough registered is to engage the change gears or other mechanism on the press to final register the press within the machine registration range.

Figure 8:
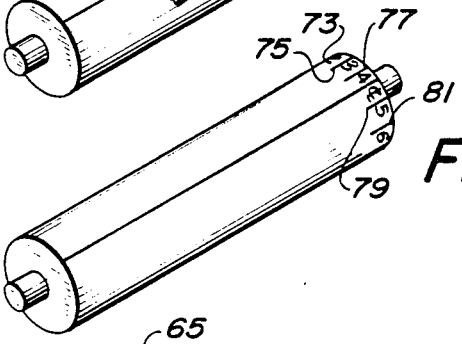
FIG. 8 is an isometric view of the same plate cylinder as in FIG. 7 with the printing plate removed from the plate roll or cylinder for storage as the cylinder would be prior to use with another printing plate.

As indicated previously, if the press is final or machine registered as well as rough registered as a first step in practicing the present invention, the rough registration attained in accordance with the invention will be particularly accurate. The registration thus attained will be in a sense be semi-final registration and only a minimum machine registration will be necessary with a minimum expenditure of time and materials. FIG. 7 shows the plate cylinder with the printing or impression plate 57 still in place. FIG. 8, on the other hand, shows the plate cylinder with the printing plate removed and the plate cylinder ready to receive any other printing plate, the center line of which will be aligned with the center line on the cylinder. So long as the center line of the impression plate is aligned with the center line on the roll the roll can be rough registered merely by aligning the appropriate station mark with the pointer on the press structure.

FIG. 14 shows plate cylinders such as shown in FIG. 7 mounted in a printing press, which in the illustration is a drum type press. The press is depicted from the top showing the drum 83 opposed to self registering plate cylinders 85 and 87 shown mounted in open top journals 89. The drum 83 is also mounted in open top journal 91. Two printing plates 93 and 94 are shown mounted on projected center line 95 on each plate cylinder. The drum type press is shown in plan view and the base and legs 97 and 99 respectively can also be seen extending to the sides. The strip 101 passes up from one side past the self registering plate cylinders 85, passes over the top of the drum 83 and passes down between the self registering plate cylinder 87 and the drum 83. As the strip 101 passes over the drum and the plate cylinders 85 and 87 rotate, the printing plates 93 and 94 will contact the strip periodically and leave an impression thereupon. In order to register the rolls in the press the station designations on the plate cylinders will be, as explained above, aligned with the pointer mechanism, the gage holding block for which mechanism will be mounted on the press structure, usually on the journal block. The pointer mechanism is not shown in FIG. 14 since the Figure illustrates the plate cylinders in position for printing. It will be understood that other cylinders for other stations not shown are located below the top cylinders shown in the Figure.

As indicated above, the invention may have several different embodiments. For example, instead of as in the embodiment described above, the station or gage marks being originally made on each plate cylinder in each station, the ummarked gage strip may be initially laid around the plate cylinders while in the press lined up as before and with the end mark on the gage strip lined up with the cut off mark on the number one plate cylinder and the center mark or line on the strip in the number two and subsequent stations aligned with the center line of the number two and up plate cylinders. The station marks may be directly recorded upon the surface of the strip by lying the strip about each cylinder in each station consecutively. In this manner the gage strip may be directly formed from the original data that would otherwise be used to mark the plate cylinders of each station with the station designations as explained above. In such case, the strip will be wrapped or laid about the plate cylinder on the surface of the cylinder as shown in FIG. 3.

In a further embodiment of the invention, each plate cylinder may be provided with an arbitrary line or other designation on its surface or side, for example a center line. The rolls of the press may then be rough registered by the normal method used by the crew of the particular press and the station designation lines or indications recorded either on the cylinder surface or on the strip gage surface under the pointer when the plate cylinders are so rough registered. A line on the surface of the gage strip will then be aligned with the arbitrary marks such as the center line on the cylinder and the station mark either on the cylinder or on the gage strip will be aligned with the pointer to provide rough registration of the plate cylinder and the printing press. It will be understood that while any arbitrary mark may be used to align the gage strip with the plate cylinder it is preferred to use either the center line on the plate cylinder or more preferably in the case of the number one station plate cylinder to use the end point mark which is lined up with the end mark on the strip gage. The advantage of using the end mark on the strip gage and the cut off point on the number one station roll plate cylinder as the alignment marks between the cylinder and the strip gage is that the strip gage need then only be a little greater in length than the circumference of the roll or the repeat distance. It will, of course, be convenient to have all the strip gages for each set of plate cylinders for a printing press of the same overall length and it is, therefore, necessary to use a strip gage which is only somewhat longer than the circumference of the largest rolls of the sets of matched rolls used in the invention.

The preparation of a series of strip gages by laying out unmarked strip gages between already prepared strip gages for the largest and the smallest set of matched plate cylinders for the printing press and then interpellating between the station designations for the smallest and the largest set of rolls by laying a diagonal between the two and marking stations designations for intermediate sized gage strips along such diagonals has been described. However, it will be understood that it is not strictly necessary to use gage strips from the largest and the smallest sets of cylinders since two gage strips from intermediate sized sets of rolls may be used, though it is preferable to use gage strips from farther apart rather than closer sets of rolls.

It will also be understood that although the invention has been shown and described with respect to the production of an individual flexible gage strip for each individual set of plate cylinders for a printing press a universal gage strip for a plurality or even all of the sets of plate cylinders for a single press could be produced. In such case each station mark would have to be designated not only with respect to the roller press print station but also with respect to the particular set or dimensions of rolls. It is in most cases more convenient and less conducive to errors in roll registration to provide a separate gage strip for each set of rolls, however.

While the invention has been described with considerable specificity in conjunction with the appended drawings and claims it is to be understood that the invention is not to be limited in its application to the details of construction and method as illustrated in the accompanied drawings or described in the specification above, but is capable of other embodiments some of which have been described or have been practiced or carried out in various ways within the scope of the appended claims. Also it is to be understood that the phraseology and terminology employed herein is for the purpose of description only and not for the purpose of limitation or construction and interpretation of the appended claims and such claims are to be interpreted to have the broadest possible valid scope when considered in light of the prior art.

I claim:

1. A method for rough registration of a set of printing plate cylinders preparatory to printing multicolor images using multiple individual printing plates mounted upon said plate cylinders in a multistation rotary type printing press using matched sets of plate cylinders comprising:

(a) providing a center line on each plate cylinder, (b) aligning the center of each printing plate with the center line on the plate cylinder upon which it is mounted, (c) bringing the plate cylinders and the respective printing plates mounted thereupon while mounted in said rotary printing press into initial at least rough registration with each other by trial and error, (d) at least partially encircling one of the plate cylinders of the at least rough registered plate cylinders with a flexible linear material having a transverse center line indication, (e) aligning the center line of said flexible linear material with the center line of said one of the plate cylinders, (f) marking the flexible linear material with an indication of its position with respect to a pointer having a pre-determined mounting position with respect to the press framework at the cylinder position in the press at which the plate cylinder is positioned when the plate cylinders of the press are in at least rough registration, (g) repeating the procedure of subparagraphs (d) through (f) for each cylinder position of the rotary printing press which is to be used to develop an alignment strip indicator in the form of an appropriately marked flexible linear material having recorded thereupon the pointer positions with respect to each plate cylinder when the plate cylinders are in at least rough registration, (h) using said alignment strip indicator to rough register plate cylinders in the printing press for a subsequent run of said press by laying said strip about said plate cylinders while the center lines of said plate cylinders and the alignment strip indicator are aligned to determine the proper initial set up angular position of said plate cylinders with said pointers on the press to provide initial rough registration of said plate cylinders used in said subsequent run prior to operation of said printing press.

2. A method for rough registration of a set of printing plate cylinders in accordance with claim 1 wherein the strip alignment indicator developed for a set of plate cylinders is used as a guide to rough register said set of plate cylinders by laying the strip alignment indicator about each roll of the set of plate cylinders with the center line of the roll and the center line of the strip aligned, rotating the plate cylinder until the registration mark developed for that plate cylinder is adjacent the pointer and locking the plate cylinder into rough registration position in the press.

3. A method for rough registration in accordance with claim 2 wherein the plate cylinders are initially brought first into rough registration prior to preparation of the alignment strip indicator and second into semi-final registration.

4. A method for rough registration of a set of printing plate cylinders in accordance with claim 1 wherein the alignment strip indicator is initially prepared by providing a strip of flexible material from several inches to somewhat less than one foot more than the repeat distance of the largest diameter set of plate cylinders for said press and marking said alignment strip indicator with a preliminary indication about 1 inch from the end.

5. A method in accordance with claim 4 for rough registration of a set of printing plate cylinders in a printing press having a series of press cylinder positions beginning with a number one press position wherein the initial indication of the pointer position for the number one press position cylinder is made after step (c) of claim 1 by determining on the first, or number one plate cylinder, the cut off point to which the printing plate extends, aligning this point with a predetermined end point on the strip alignment indicator and the processing with subsequent plate cylinders as in steps (d) through (h) of claim 1.

6. A method for rough registration of a set of printing plate cylinders in accordance with claim 1 wherein a strip alignment indicator is developed for a larger set of plate cylinders and for a smaller set of plate cylinders of a group of matched groups of plate cylinders that may be used in the rotary printing press, wherein such strip alignment indicators are arranged with a series of additional blank strip alignment indicators with each strip matched with a set of plate cylinders for said rotary printing press in descending or ascending order of cylinder size, and a series of pointer position indications are made on the strip for each cylinder position in the printing press on a diagaonal straight line connecting the indication of said same cylinder position on the strip alignment indicators for said larger and said smaller sets of cylinders to develop a strip alignment indicator for at least several of the sets of cylinders and using said strip alignment indicators as guides to rough register one or more of said sets of cylinders by laying said strips about the plate cylinders of the matched series of plate cylinders with the center lines of said respective cylinders and said respective strips aligned to determine the proper initial set angular position of said cylinders with said pointer positions by aligning the pointer positions with the strip alignment position for each plate cylinder to provide initial rough registration of said plate cylinders prior to operation of said printing press.

7. A method for rough registration of a set of printing plate cylinders in accordance with claim 1 additionally comprising laying the said strip alignment indicator about each of the plate cylinders of a corresponding set of identical sized cylinders and marking upon substantially each cylinder an indication of the pointer position for each cylinder position in the printing press and subsequentially using said marks upon said plate cylinders to rough register the plate cylinder in a rotary type printing press by aligning the appropriate marks upon the plate cylinders with a pointer positioned in a predetermined position on the press structure.

8. A method for rough registration of a set of printing plate cylinders in accordance with claim 6 additionally comprising laying one or more of the said strip alignment indicators about substantially each of the cylinders of corresponding sets of identically sized cylinders and marking upon said cylinders an indication of the pointer position with respect to each cylinder position in the printing press and subsequently using said marks upon said cylinders to rough register plate cylinders in the rotary type printing press by aligning the appropriate mark with the pointer positioned at each cylinder position in the press structure.

9. A method for rough registration of a set of printing plate cylinders for a plurality of runs of said cylinders on a multistation rotary type printing press using matched sets of plate cylinders comprising:

(a) providing a reference mark on each cylinder, (b) bringing the cylinders while mounted in the printing press into rough registration by a standard method for rough registering a series of plate cylinders carrying printing plates, (c) determining and recording the portion of each plate cylinder which is adjacent to a prepositioned indicator mounted in a predetermined position at substantially each printing station, (d) transferring such recorded position onto a flexible gage strip as an indication of the cylinder position adjacent said prepositioned indicator when the cylinders are in rough registration while a reference mark on the flexible gage strip is aligned with the reference mark on substantially each cylinder, (e) repeating the transfer of the recorded position onto the flexible gage strip for substantially each cylinder of a matched set of cylinders, (f) using the flexible gage strip to subsequently rough register the plate cylinders in the printing press by aligning the reference marks of the cylinders and the reference mark on the flexible gage strip and aligning the recorded position of the cylinders with a prepositioned indicator for substantially each roll station.

10. A method for rough registration of a set of printing plate cylinders in accordance with claim 9 wherein the position of each plate cylinder adjacent the prepositioned indicator at substantially each printing station is directly recorded on the flexible gage strip while said gage strip is laid about the plate cylinder mounted in the press at such station.

11. A method for rough registration of a set of printing plate cylinders in accordance with claim 9 wherein the position of each plate cylinder adjacent to the prepositioned indicator position at substantially each printing station is initially recorded upon the cylinder and subsequently recorded on the gage strip.

12. A method for rough registration of a set of printing plate cylinders in accordance with claim 11 wherein after the position of the plate cylinder adjacent the prepositioned indicator for substantially each printing station is recorded on the gage strip, said gage strip is laid about each cylinder of a matched set of plate cylinders and corresponding station position indications are marked on substantially each roll of the matched set of rolls whereby each cylinder can be used in any station of the printing press and rough registered with respect to the prepositioned indicator for such station.

13. A method for rough registration of a set of printing plate cylinders in accordance with claim 10 wherein a gage strip is prepared for a larger and a smaller set of matched plate cylinders for such printing press and the two gage strips are then used to prepare gage strips for other matched sets of cylinders by interpolation with respect to markings of the two gage strips.

14. A method for rough registration of a set of printing plate cylinders in accordance with claim 11 wherein a gage strip is prepared for a larger and a smaller set of matched plate cylinders for such printing press and the two gage strips are then used to prepare gage strips for other matched sets of cylinders by interpolation from the markings of the two gage strips.

15. A method for rough registration of a set of printing plate cylinders in accordance with claim 13 additionally comprising laying the gage strips formed by interpolation from previous gage strips about appropriate plate cylinders from sets of matched plate cylinders and transferring the station position indications from the gage strips to substantially all the cylinders of each corresponding matched sets of cylinders.

16. A method for rough registration of a set of printing plate cylinders in accordance with claim 14 additionally comprising laying the gage strips formed by interpolation about appropriate plate cylinders from sets of matched plate cylinders and transferring the station position indications from the gage strips to substantially all the cylinders of each corresponding matched set of cylinders.

17. A method for rough registration of a set of printing plate cylinders in accordance with claim 9 additionally comprising after initially bringing the cylinders into rough registration further bringing the said cylinders into fine machine registration prior to determining the portion of the cylinders adjacent to the prepositioned indicator.

18. A method f forming a registration facilitating plate cylinder adapted for self registration of a rotary printing press using matched sets of printing plate cylinders adapted for mounting thereupon of individual printing plates comprising:

(A) providing a strip alignment indicator formed in accordance with the following steps:

(1) providing a center line on each cylinder of a matched set of printing plate cylinders, (2) aligning the center of each printing plate on the plate cylinders with the center line on its cylinder, (3) bringing the plate cylinders and their respective printing plates into initial at least rough registration with each other by trial and error, (4) at least partially encircling one of the plate cylinders with a flexible linear material having a transverse center line indicia, (5) aligning the center line indicia of said flexible linear material with the center line of one of the plate cylinders, (6) marking the flexible linear material with an indication of its position with respect to the position of a pointer having a predetermined mounting position with respect to the press framework at the cylinder position in the press at which the plate cylinder is positioned when the cylinders of the press are in rough registration, (7) repeating the procedure of subparagraphs (4) through (6) for each cylinder position of the rotary printing press which is to be used to develop an alignment strip indicator having recorded thereupon the pointer positions with respect to each roll when the press cylinders are in at least rough registration, (B) using the strip alignment indicator made in accordance with steps 1 to 7 of (a) above to form a self-registering plate cylinder by:

(i) laying the strip alignment indicator about a plate cylinder of identically sized set of plate cylinders with the center line of the strip alignment indicator aligned with the center line of the plate cylinder, (ii) marking indications of the pointer positions appearing on the strip alignment indicator for each cylinder position of the press on the plate cylinder to provide an indication on such cylinder of its rough registration alignment position for each cylinder position of the rotary printing press.

* * * * *